US009816060B2

(12) United States Patent
Coxon

(10) Patent No.: US 9,816,060 B2
(45) Date of Patent: Nov. 14, 2017

(54) EFFERVESCENT CLEANING COMPOSITION COMPRISING DIAMOND POWDER HAVING DV50 OF LESS THAN 40 MICROMETER

(71) Applicant: DF&G LTD, Essex (GB)

(72) Inventor: Andrew Coxon, Essex (GB)

(73) Assignee: DF&G LTD, Essex (GB)

( * ) Notice: Subject to any disclaimer, the term of this patent is extended or adjusted under 35 U.S.C. 154(b) by 19 days.

(21) Appl. No.: 14/345,157

(22) PCT Filed: Sep. 21, 2012

(86) PCT No.: PCT/GB2012/052353
§ 371 (c)(1),
(2) Date: Mar. 14, 2014

(87) PCT Pub. No.: WO2013/041886
PCT Pub. Date: Mar. 28, 2013

(65) Prior Publication Data

US 2015/0000700 A1 Jan. 1, 2015

(30) Foreign Application Priority Data

Sep. 21, 2011 (GB) ..... 1116305.2

(51) Int. Cl.

| | |
|---|---|
| ***B08B 3/08*** | (2006.01) |
| ***C11D 17/00*** | (2006.01) |
| ***C11D 3/00*** | (2006.01) |
| ***C11D 3/02*** | (2006.01) |
| ***C11D 3/10*** | (2006.01) |
| *C11D 17/06* | (2006.01) |
| *C11D 7/02* | (2006.01) |
| *C11D 7/12* | (2006.01) |
| *C11D 7/10* | (2006.01) |
| *B08B 3/04* | (2006.01) |

(52) U.S. Cl.
CPC ..... *C11D 17/0073* (2013.01); *B08B 3/08* (2013.01); *C11D 3/0052* (2013.01); *C11D 3/02* (2013.01); *C11D 3/10* (2013.01); *C11D 17/0013* (2013.01); *B08B 3/04* (2013.01); *B08B 3/044* (2013.01); *C11D 7/02* (2013.01); *C11D 7/10* (2013.01); *C11D 7/12* (2013.01); *C11D 17/06* (2013.01)

(58) Field of Classification Search
CPC .... C11D 7/02; C11D 7/10; C11D 7/12; C11D 17/0047; C11D 17/0073; C11D 17/06; C11D 17/0013; B08B 3/04; B08B 3/044
See application file for complete search history.

(56) References Cited

U.S. PATENT DOCUMENTS

| | | | | |
|---|---|---|---|---|
| 3,574,580 | A * | 4/1971 | Stromberg et al. | B01J 3/062 423/446 |
| 4,339,281 | A * | 7/1982 | Chio | B08B 3/12 134/1 |
| 5,133,792 | A | 7/1992 | Purohit et al. | |
| 5,306,439 | A | 4/1994 | Lockhart | |
| 5,578,562 | A * | 11/1996 | Lockhart | C11D 3/0052 510/446 |
| 5,921,856 | A | 7/1999 | Zimmer | |
| 6,110,573 | A | 8/2000 | Kobayashi et al. | |
| 6,258,721 | B1 | 7/2001 | Li et al. | |
| 6,645,930 | B1 | 11/2003 | Wallis et al. | |
| 2002/0017063 | A1 | 2/2002 | Beitel et al. | |
| 2004/0031205 | A1 | 2/2004 | Ohishi | |
| 2005/0026798 | A1* | 2/2005 | Hollander | A61L 11/00 510/194 |
| 2005/0220829 | A1 | 10/2005 | Sung et al. | |
| 2006/0211340 | A1 | 9/2006 | Thysell | |
| 2007/0184121 | A1* | 8/2007 | Sung | A61K 8/11 424/499 |
| 2008/0293332 | A1 | 11/2008 | Watanabe et al. | |
| 2009/0326160 | A1 | 12/2009 | Kimura | |
| 2010/0254915 | A1 | 10/2010 | Kao | |
| 2010/0293865 | A1 | 11/2010 | Watanabe et al. | |
| 2011/0305917 | A1 | 12/2011 | Mineif | |
| 2012/0094581 | A1* | 4/2012 | Sharma | B24C 1/003 451/38 |
| 2012/0220207 | A1 | 8/2012 | Dean | |
| 2012/0304693 | A1* | 12/2012 | Rizzo | A44C 17/02 63/28 |
| 2014/0057533 | A1 | 2/2014 | Long et al. | |
| 2014/0283874 | A1 | 9/2014 | Coxon | |

FOREIGN PATENT DOCUMENTS

| | | |
|---|---|---|
| CN | 102631164 A | 8/2012 |
| WO | WO 2006/083570 A2 | 8/2006 |

* cited by examiner

*Primary Examiner* — Bibi Carrillo
(74) *Attorney, Agent, or Firm* — Saliwanchik, Lloyd & Eisenschenk

(57) ABSTRACT

A composition which effervesces when added to water, comprises diamond particles with a median equivalent volumetric diameter (Dv50) of less than 40 μm. The compositions are useful as cleaning compositions, particularly for cleaning diamonds.

5 Claims, No Drawings

EFFERVESCENT CLEANING COMPOSITION COMPRISING DIAMOND POWDER HAVING DV50 OF LESS THAN 40 MICROMETER

CROSS REFERENCE TO A RELATED APPLICATION

This application is a National Stage Application of International Application Number PCT/GB2012/052353, filed Sep. 21, 2012; which claims priority to Great Britain Application No. 1116305.2, filed Sep. 21, 2011; which are incorporated herein by reference in their entirety.

FIELD OF THE INVENTION

The present invention relates to compositions suitable for cleaning diamonds, for example diamond jewellery.

BACKGROUND OF THE INVENTION

Diamonds are commonly found in jewellery, and are the most favoured stone for engagement rings. They are chosen for their hardness, value and brilliance. When choosing a diamond, it is important to take into account the "four C's"; carat weight, clarity, cut and colour. Each of these features affects the overall appearance of the stone.

To most wearers, the "four C" credentials of a diamond are secondary to whether the diamond "sparkles" and has fire, life and brilliance. This is determined to some extent by cut, clarity and transparency, but also by how clean the surface of the diamond is. A diamond rapidly loses its brilliance when it becomes opaque through contact with substances such as moisturising lotions, and eventually becomes dirty when skin particles and dust adhere and accumulate behind the diamond. This will not wash off with water.

Since diamonds are favoured for engagement rings, which are worn every day, they very quickly become dirty. Often the wearers see a reduction in fire, life and brilliance within just a few days of constant wear. Diamonds have a very high affinity for grease, and day-to-day activities such as showering, doing the washing up and applying hand cream, all leave a residue on the diamond, which causes it to become dull. Oils and greases are hydrocarbons, which tend to stick well to surfaces that do not contain oxygen. A diamond surface, therefore, which is pure carbon, is ideal.

The most effective way to clean a diamond is to take it to a jeweller, and have it professionally cleaned. Jewellers often have specialist cleaning solutions and ultrasonic cleaning machines at their disposal, which are very effective. However, this often incurs a fee, and it may not be practical for a person to take all of their diamond jewellery to the jewellers on a very regular basis. Additionally, people are sometimes embarrassed by the dirt that builds up on their jewellery, particularly in the case of diamond earrings, and often prefer to clean their jewellery at home.

Over the years, a number of diamond jewellery cleaning methods have been used in the home. For example, a solution of washing up liquid in water can often be effective, as can soaking the jewellery in alcohol, such as gin. One method that has been reported is the use of effervescent denture cleaners, such as Steradent® or Poligrip®. However, many people would be very hesitant to use this method. Firstly, it is not recommended by the manufacturers, and secondly, tests show that metals, such as 18K to 9K gold, and also silver will tarnish upon exposure to most dental cleaning products. Therefore this method would certainly not be considered suitable for all diamond jewellery.

Although several cleaning methods are known in the art, no satisfactory cleaning method has been found which achieves results close to that of a professional clean by the jeweller in their shop.

SUMMARY OF THE INVENTION

It is surprisingly found that when fine diamond particles are added to an effervescent composition, the solution formed is extremely useful at cleaning diamond jewellery in the home. The effervescing action of the composition works to remove opaqueness and most of the dirt, while the diamond particles further work to improve the appearance of the diamond. It is believed that this is achieved in part by the absorption of the fine diamond powder or dust by the oils and grease on the surface of the diamond, particularly from the back of the diamond, where most accumulation occurs. This absorption of fine diamond particles greatly increases the cleaning action of the effervescent cleaner.

It is also surprising that, given the abrasive nature of diamond, the diamond particles result in a satisfactory clean without causing any damage to the surface of the diamond being cleaned. Instead, they appear to have a polishing effect on the diamond, which is enhanced by the effervescing action of the composition. It is also surprising that the diamond particles do not stick to the surface of the diamond, but instead rinse off easily with water. The cleaning may also be further enhanced by a final light brushing action to remove larger residues from the back of the ring or earring, for example. The final result is that the cleaned diamond has recovered most of its original fire, life and brilliance.

According to a first aspect, the present invention is a composition which effervesces when added to water, comprising diamond particles with a median equivalent volumetric diameter (Dv50) less than 40 μm.

According to a second aspect, the present invention is a tablet comprising a composition as described above, and which effervesces and is soluble in water.

According to a third aspect, the present invention is a method of cleaning a diamond item comprising placing the item into a clear dispersion of water and a tablet as described above, for a period of time, and then removing the item from the water, and then rinsing with water.

Diamond particles can also be used alone to clean the surface of a diamond. Therefore, according to a fourth aspect, the present invention is the use of diamond particles with a Dv50 of less than 40 μm, to clean a diamond.

DESCRIPTION OF THE PREFERRED EMBODIMENTS

A composition of the invention should include means for achieving effervescence when added to water, and diamond particles. The means for achieving effervescence is preferably a mixture of agents, such as a mixture of a powdered acid and carbonate. Suitable effervescent agents will be known to those skilled in the art.

The term "effervescent" is known in the art. A composition which is said to effervesce when added to water means that visible bubbles can be seen when the composition is added to water, caused by the escape of dissolved gases from the solution.

As used herein, diameter means equivalent volumetric diameter. This is the diameter of a spherical particle having the same constitution and volume as the particle being measured. This is a standardised technique to take into account the fact that not all particles are perfect spheres.

The equivalent volumetric diameter is preferably measured by laser diffraction. Light from a laser is shone into a cloud of particles, which are suspended in a transparent gas such as air. The particles scatter the light; smaller particles scattering the light at larger angles than bigger particles. The scattered light can be measured by a series of photodetectors placed at different angles. This is known as the diffraction pattern for the sample. The diffraction pattern can be used to measure the size of the particles using well documented light scattering theory. The particles are assumed to be spherical but few particles are actually spherical. The particle diameters are calculated from the measured volume of the particle, but assume a sphere of equivalent volume.

In the present invention, a composition may be said to comprise particles having a median equivalent volumetric diameter (Dv50) of x μm. This is a statistically derived figure that is understood in the art and this means that, in a particular sample, 50% of the particles will have an equivalent volumetric diameter of x μm or greater and 50% of the particles will have an equivalent volumetric diameter of less than x μm.

The Dv50 (median equivalent volumetric diameter) can also be measured by dynamic light scattering (DLS).

The diameter of the diamond particles is critical. If the diamond particles are too large, then they may damage the diamond by scratching it, or they may cause it to become loose in its setting. Furthermore, it is necessary for the diamond particles to have a large combined surface area, so that the maximum amount of grease can be polished from the surface of the diamond being cleaned. Therefore, the diamond particles should have a Dv50 of less than 40 μm. Preferably, the diamond particles have a Dv50 of less than 35, 30, 25 or 20 μm. More preferably, the diamond particles have a Dv50 of less than 10 μm 8, 7, 6, 5, 4, 3, 2 or 1 μm.

In a preferred embodiment, the Dv50 of the diamond particles lies within a particular range. Preferred lower limits are 0, 1 nm, 10 nm, 50 nm, 100 nm, 500 nm, 1 nm, 2 nm 10 nm or 100 nm. Preferred upper limits are 2 μm, 3 μm, 4 μm, 10 μm, 15 μm, 20 μm, 25 μm, 30 μm or 35 μm. Any of the aforementioned lower limits can be combined with the aforementioned upper limits.

Preferably, if the Dv50 is expressed as x μm, 75% of the particle diameters are x±20%, preferably x±10%, more preferably x±5%. Preferably, 80, 85, 90, 95 or 98% of the particles are within the specified range.

The diamond dust (particles) that is used in the invention may be natural or synthetic. Preferably, the diamond particles that are used in the present invention are from natural diamonds.

Natural diamond dust (particles) is commercially available. This dust is the by-product of the rounding process of larger natural rough diamonds within metal cylinders. The dust is recovered by cleaning the metal cylinders with an acid, which does not affect the diamonds, but does release the dust which has become impregnated into the metal during the rounding process.

Examples of sizes (expressed in μm) of natural diamond dust that are commercially available, and which are therefore suitable for use in the invention are: 0-1, 0-2, 1-3, 2-3, 2-4, 3-5, 4-8, 5-10, 6-12, 7-10, 8-15, 10-20, 15-25, 20-40, 30-40.

A range of sizes of synthetic nano diamond dust is also available commercially.

A composition of the invention effervesces when water is added. There are a number of agents that can be used to achieve this effervescing action, and these will be known to a person skilled in the art. An example of suitable agents, which effervesce when added to water, is a mixture of a carbonate (or bicarbonate) and an acid.

In a preferred embodiment, a composition of the invention comprises a metal bicarbonate or carbonate. Preferably the metal is a Group 1 or Group 2 metal, and examples include sodium and magnesium. In a preferred embodiment, the metal bicarbonate or carbonate is sodium bicarbonate.

In a preferred embodiment, a composition of the invention comprises a polymer such as polyethylene glycol (PEG).

In a preferred embodiment, a composition of the invention comprises a metal sulphate. Preferably the metal is a Group 1 or Group 2 metal, and examples include sodium and magnesium. Preferably, the metal sulphate is sodium sulphate. More preferably, the metal sulphate is potassium peroxymonosulphate.

In a preferred embodiment, a composition of the invention comprises an acid. Preferably, the acid is a weak acid. By weak acid, it is meant an acid that does not dissociate completely when added to water. More preferably, it is a weak organic acid. Most preferably, the acid is citric acid.

In a preferred embodiment, a composition of the invention also comprises a peroxide, such as a metal carbonate peroxide. Preferably the metal is a Group 1 or Group 2 metal, and examples include sodium and magnesium. More preferably, the peroxide is sodium carbonate peroxide.

Preferably, a composition of the invention comprises a fragrance.

In a preferred embodiment, a composition of the invention comprises from 0.001 to 1% diamond particles, preferably 0.001 to 0.5%, 0.005 to 0.015% about 0.01 wt. %. Without wishing to be bound by theory, even the presence of a very small amount of diamond particles makes a large difference to the cleaning action. This is believed to be due to the very large surface area of the diamond particles, and the fact that they have such a high affinity for grease.

For example, to illustrate that point, a 1.5 g tablet formulated according to the invention and containing 0.01 wt. % diamond powder with a Dv50 of around 1 μm, will contain in excess of 200 million particles. Due to the large number of particles, it would be possible to cover an entire surface of a diamond in diamond dust, which would work synergistically with the effervescing action of the composition, to remove all grease and dirt from the surface of a diamond.

In a preferred embodiment, a composition of the invention comprises:

50-60 wt. % of a metal carbonate or bicarbonate;

20-30 wt. % of a weak acid;

0.005-1 wt. % of diamond particles; and optionally additional components selected from a polymer such as polyethylene glycol, a surfactant such as lathanol LAL and a sulphate.

A composition of the invention may be formulated as a powder, which may then be added to water to produce a clear cleaning dispersion according to the invention. The powder may be packaged in substantially airtight container or bag. A composition of the invention may be held within a porous material, such as a mesh. This material should be water-permeable to allow the solution to be formed, and the effervescence to occur.

Preferably, a composition of the invention is formulated as a tablet. More preferably, the tablet is shaped like a rough or polished diamond. In a preferred embodiment, a tablet of the invention has a mass of between 0.5 g and 5 g, preferably 1 g to 4 g, more preferably 1 g to 3 g.

In order to clean an item of jewellery, the tablet should be added to water together with the item of jewellery, and allowed to sit for a period of time, such that the item is cleaned by the combined action of the effervescence and the action of the diamond dust. Preferably, the water is at a temperature of greater than 40° C., more preferably around 40-70° C., i.e. it should be hot to the touch but not necessarily boiling. However, boiling water will not harm the diamond. In fact, it may increase the effervescing action of the cleaning solution.

Preferably, the item of jewellery (or the item containing the diamond) should be brushed using a soft brush to remove any residue. It should also be rinsed under running water. The act of rinsing the item under running water can help remove the diamond dust and therefore the grease/dirt from the item, ie. the diamond.

Preferably, the tablet is added to water, whereupon it effervesces to form a clear dispersion (the diamond particles cannot be seen by the naked eye).

The following examples illustrate the invention.

EXAMPLE 1

A tablet of the invention was formulated according to the following specifications:

Diamond Powder:

Particle size distribution as determined in aqueous solution by Dynamic Light Scattering (DLS) is 960 nm+/−330 nm. Within each 1.5 g tablet, there are estimated to be >200 million particles.

Diamond Cleaning Tablets 1.5 g tablets were formulated containing a w/w composition of 55-57% sodium bicarbonate, 12-14% potassium peroxymonosulfate (Oxone), 21-23% citric acid and 0.01% diamond powder. These were compacted into a tablet form.

Contaminated Test Substrate

Standard borosilicate laboratory glass microscope slides were cleaned in concentrated $H_2SO_4$ acid, washed in deionised water, then rinsed with AR grade ethanol prior to being allowed to air dry.

A 2% solution of paraffin wax (98° C. Congealing temperature) was prepared by dissolving wax into hexane at 60° C. Glass slides were 50% coated (ie. only one end) with the solution, then allowed to air dry. The slides were then annealed at 120° C. to allow the paraffin film to adhere to the glass slides. The final paraffin film thickness was 200 μm+−20 μm.

Cleaning Test 75 ml of deionised water was heated to 60° C. in 100 ml beakers. A contaminated test slide was placed in the beaker with the coated end fully immersed in the water. Two cleaning tablets were then placed in the beaker. Effervescence continued for typically 3 minutes after which the slide was removed from the beaker and washed with deionised water. The slides were then allowed to air dry prior to visual inspection under optical microscopy in both reflection and transmission modes. This inspection indicated the complete removal of the paraffin film from the slide.

A control experiment was also performed in which a contaminated slide was immersed in a 60° C. beaker of deionised water without the addition of the test tablets for 3 minutes. This slide was also washed in deionised water prior to drying and microscopic visualisation. The control experiment showed that the paraffin film was fully intact on the microscope slide after this experiment.

A detailed inspection of the slides was made and no visible scratches were observed on either slide.

EXAMPLE 2

A tablet as formulated above was added to a glass of hot water. A diamond ring coated in a grease composition (lip salve) was then added to the effervescing composition, and left for around 3 minutes. The ring was then rinsed under running hot water and it was observed that the natural fire, life and brilliance of the diamond was restored and all sediment removed from the surface of the diamond.

The invention claimed is:

1. A method of cleaning a diamond item comprising placing the item into a clear aqueous dispersion consisting of water and having dispersed therein a composition consisting of 0.001 wt. % to 0.5 wt. % diamond particles with a median equivalent volumetric diameter (Dv50) of less than 40 μm, 50-60 wt. % of a metal carbonate or bicarbonate, 20-25 wt. % of a weak acid and a sulphate, wherein the diamond item remains in the dispersion for a period of time sufficient for the dispersed diamond particles to clean the item, and then removing the item from the dispersion, and then rinsing the item with water, and wherein the composition effervesces when the composition is added to the water forming said dispersion such that the diamond particles become dispersed in the water.

2. The method of cleaning a diamond according to claim 1, wherein the water used for cleaning the diamond item is at a temperature of greater than 40° C.

3. The method of cleaning according to claim 1, wherein the item is placed into the dispersion for up to 5 minutes and rinsed with running water for more than 5 seconds.

4. The method of cleaning a diamond, according to claim 1, wherein the diamond particles have a Dv50 of less than 20 μm.

5. The method of cleaning a diamond, according to claim 1, wherein the diamond particles have a Dv50 of less than 10 μm.

* * * * *